US008833690B2

(12) United States Patent
Zhou et al.

(10) Patent No.: US 8,833,690 B2
(45) Date of Patent: Sep. 16, 2014

(54) WIRE-WINDING DEVICE

(75) Inventors: Cong-Bing Zhou, Shenzhen (CN); Che-Yu Chou, New Taipei (TW); Qun Huang, Shenzhen (CN); Tai-Shan Zhu, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 201 days.

(21) Appl. No.: 13/525,367

(22) Filed: Jun. 18, 2012

(65) Prior Publication Data

US 2013/0062451 A1 Mar. 14, 2013

(30) Foreign Application Priority Data

Sep. 9, 2011 (CN) ..... 2011 1 0267313

(51) Int. Cl.
*B65H 75/48* (2006.01)

(52) U.S. Cl.
USPC ..... 242/378; 242/378.1; 242/378.2; 242/378.3

(58) Field of Classification Search
USPC ..... 242/378, 378.1–378.3, 388, 242/388.1–388.4
See application file for complete search history.

(56) References Cited

U.S. PATENT DOCUMENTS

| | | | | |
|---|---|---|---|---|
| 6,866,218 | B2 * | 3/2005 | Liao | 242/378.1 |
| 7,028,939 | B2 * | 4/2006 | Liao | 242/378 |
| 7,455,255 | B1 * | 11/2008 | Chao | 242/378.1 |
| 7,494,083 | B1 * | 2/2009 | Yen | 242/378.1 |
| 7,900,863 | B1 * | 3/2011 | Cheng | 242/378.1 |
| 2005/0184186 | A1 * | 8/2005 | Tsoi et al. | 242/378.1 |
| 2013/0153701 | A1 * | 6/2013 | Huang et al. | 242/385.2 |

* cited by examiner

*Primary Examiner* — Sang Kim
(74) *Attorney, Agent, or Firm* — Novak Druce Connolly Bove + Quigg LLP

(57) ABSTRACT

An exemplary wire-winding device can automatically wind a wire that is connected to a plug such as the plug of an earphone set. The wire-winding device includes a rotary wire-winding unit and a locking unit. A plug inlet channel and a moving cavity are defined in the rotary wire-winding unit. The locking unit includes a moving member accommodated in the moving cavity, for controlling locking and releasing of the rotary wire-winding unit. When the plug is inserted into the moving cavity, the plug applies a thrust force to the moving member, and the moving member moves in the moving cavity under the thrust force and thereby releases the rotary wire-winding unit to allow the rotary wire-winding unit to rotate and automatically wind the wire.

20 Claims, 6 Drawing Sheets

WIRE-WINDING DEVICE

BACKGROUND

1. Technical Field

The disclosure relates to wire-winding devices used with electronic equipment such as consumer electronic products, and especially a wire-winding device typically used for an earphone set.

2. Description of Related Art

An earphone set may include one or two earpieces, together with a wire having a plug on an end thereof. The plug is connected to an earphone port of an electronic device, such as a mobile phone, an MP3 (Moving Picture Experts Group, audio layer 3) player, a CD (compact disc) player and the like, and thus the earpieces can receive sound signals from the electronic device. Such an earphone set enables mobile use of electronic devices, for example when walking, running, driving a car, or working. For all these uses, an adequate length of the wire is required, but the wire may tangle and cause inconvenience.

BRIEF DESCRIPTION OF THE DRAWINGS

The accompanying drawings are included to provide a further understanding of the disclosure, and are incorporated in and constitute a part of this application. The drawings illustrate embodiments of the disclosure and, together with the description, serve to explain the principles of the disclosure.

DETAILED DESCRIPTION

Figure 1:
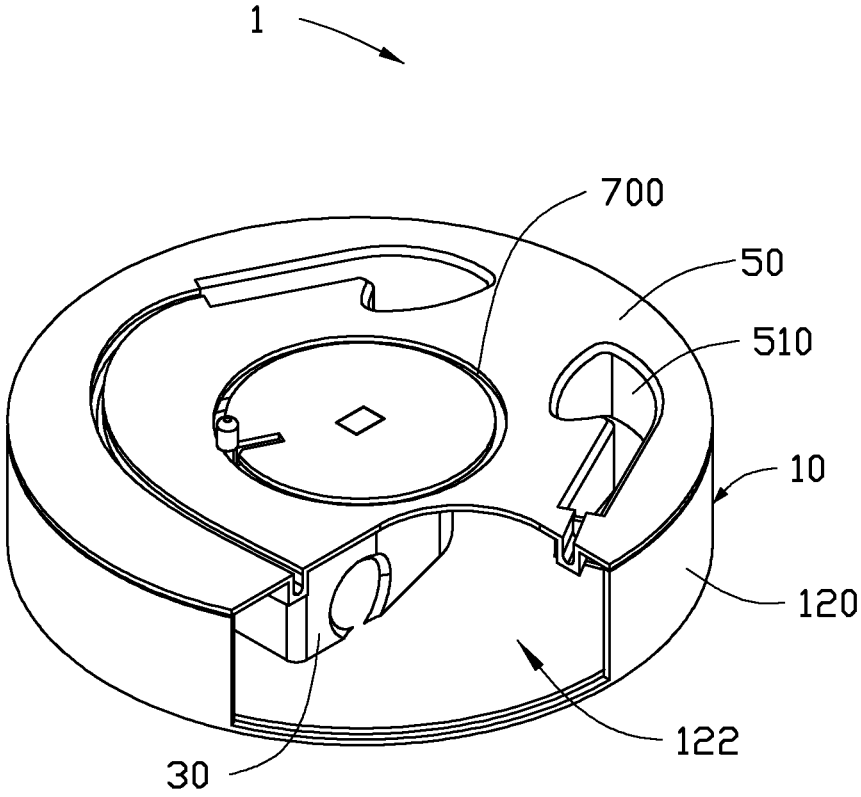
FIG. 1 is a perspective view of a wire-winding device according to an exemplary embodiment of the present disclosure.

Examples of the present embodiments are illustrated in the accompanying drawings. Wherever possible, the same or similar reference numbers are used, in the drawings and the description, to refer to the same or like parts.

Referring to FIG. 1, a wire-winding device 1 includes a housing 10, and a rotary wire-winding unit 30 accommodated in the housing 10. A top cover 50 is seated on a top circumferential edge of the housing 10. Thus the interior of the housing 10 is concealed by the top cover 50, except that a through hole 530 (see FIG. 2) is defined in a center of the top cover 50. A circumferential side wall 120 of the housing 10 is almost completely closed, and thereby defines an entrance 122. The entrance 122 allows a wire 80 (see FIG. 5) of an associated earphone set to be routed into and out of the rotary wire-winding unit 30. In the embodiment, the top cover 50 further includes a pair of accommodation grooves 510, for stowing two earpieces of the earphone set and two corresponding end portions of the wire 80 (the end portions are not shown in FIG. 5).

Figure 2:
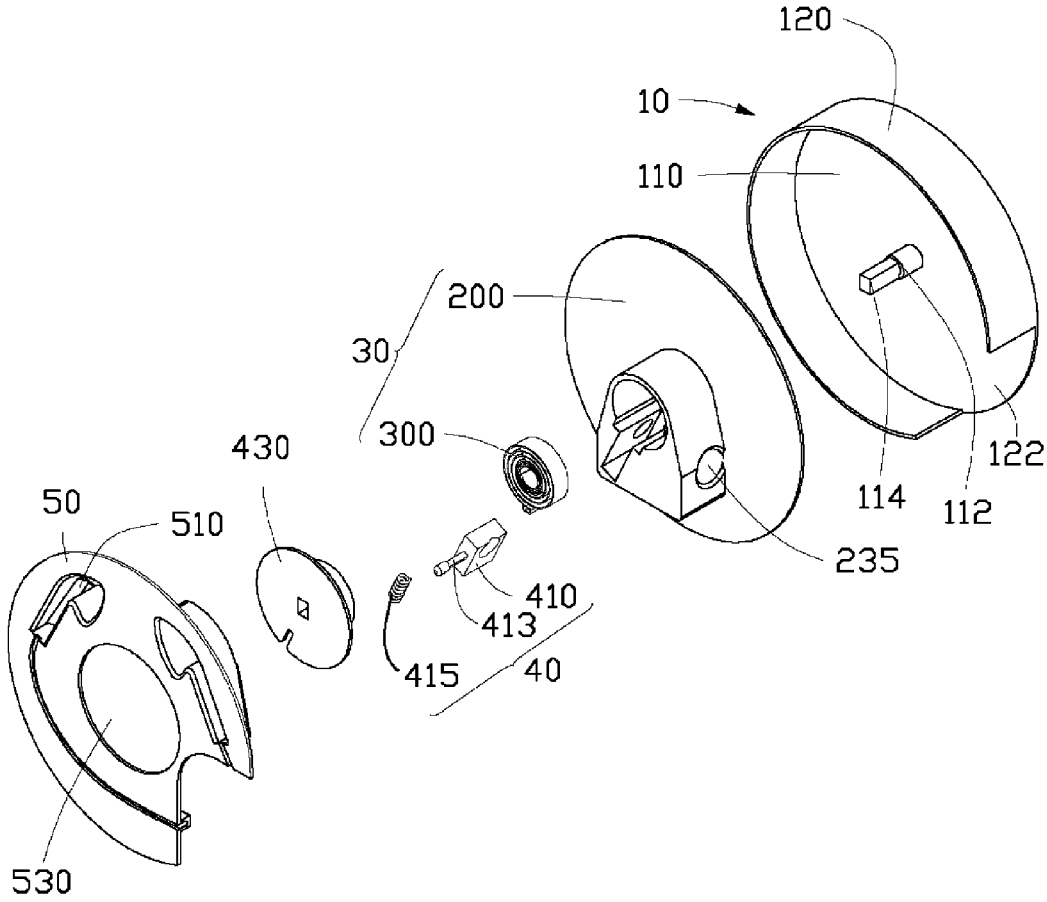
FIG. 2 is an exploded perspective view of the wire-winding device of FIG. 1, the wire-winding device including a rotary wire-winding unit.

Referring also to FIG. 2, a pivot 112 with a securing shaft 114 is provided on a base plate 110 of the housing 10. In the embodiment, the pivot 112 has a cylindrical lateral surface. The securing shaft 114 extends coaxially from an end of the pivot 112 which is away from the base plate 110. In the illustrated embodiment, the securing shaft 114 has a rectangular transverse cross-section.

Figure 3:
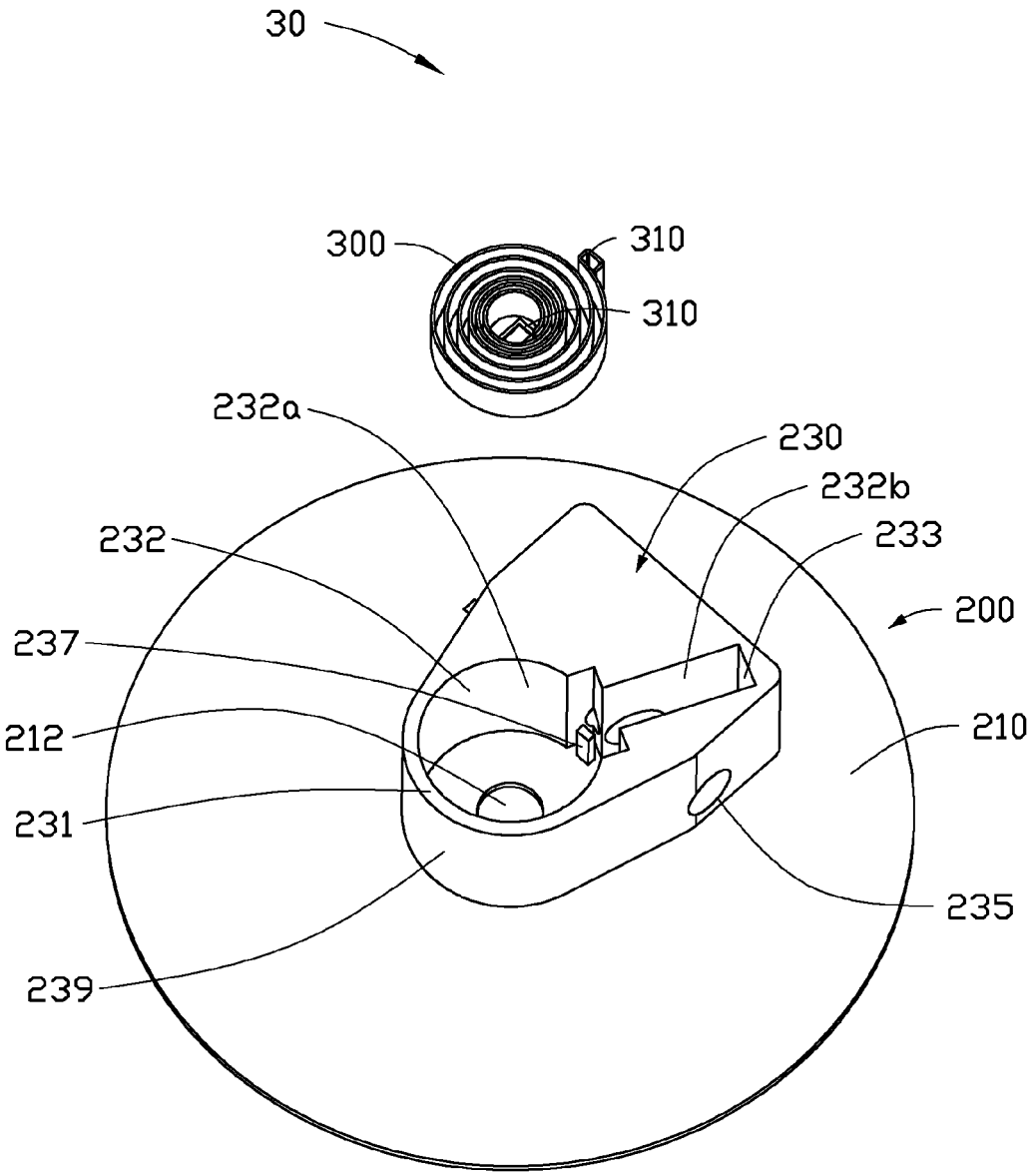
FIG. 3 is an enlarged perspective view of the rotary wire-winding unit of FIG. 2.

Referring also to FIG. 3, the rotary wire-winding unit 30 is configured to automatically rewind the wire 80 of the earphone set anytime after the wire 80 has been drawn out, as will be detailed below. The rotary wire-winding unit 30 includes a rotation body 200 and a torsion spring 300. The rotation body 200 is sleeved on the pivot 112 to rotate about the pivot 112, and includes a supporting plate 210 and an accommodation member 230 provided on the supporting plate 210. A shaft hole 212 is defined through the supporting plate 210, and corresponds to the pivot 112. That is, the pivot 112 is insertable into the shaft hole 212 to sleeve the rotation body 200 on the pivot 112.

A part of the accommodation member 230 is recessed from a top face of the accommodation member 230 towards the supporting plate 210, to form an indentation 232 in communication with the shaft hole 212. Thus, a closed side wall 231 of the accommodation member 230 surrounds the indentation 232. An external surface of the closed side wall 231 serves as a wire-collecting surface 239 where the wire 80 of the earphone set is wound up. The indentation 232 includes a cylindrical accommodation cavity 232*a* in which the torsion spring 300 is accommodated, and a straight moving cavity 232*b* with a smooth internal surface. In the illustrated embodiment, the accommodation cavity 232*a* and the moving cavity 232*b* are in communication with each other. In an alternative embodiment, the accommodation cavity 232*a* and the moving cavity 232*b* are not in communication with each other. A portion of the closed side wall 231 at an end of the moving cavity 232*b* farthest from the accommodating cavity 232*a* functions as an abutting wall 233.

One end 310 of the torsion spring 300 is coiled around the securing shaft 114. The other end 310 of the torsion spring 300 is bent into a hook, and is hooked around a latching member 237 located in a bottom of the accommodation cavity 232*a*.

Figure 4:
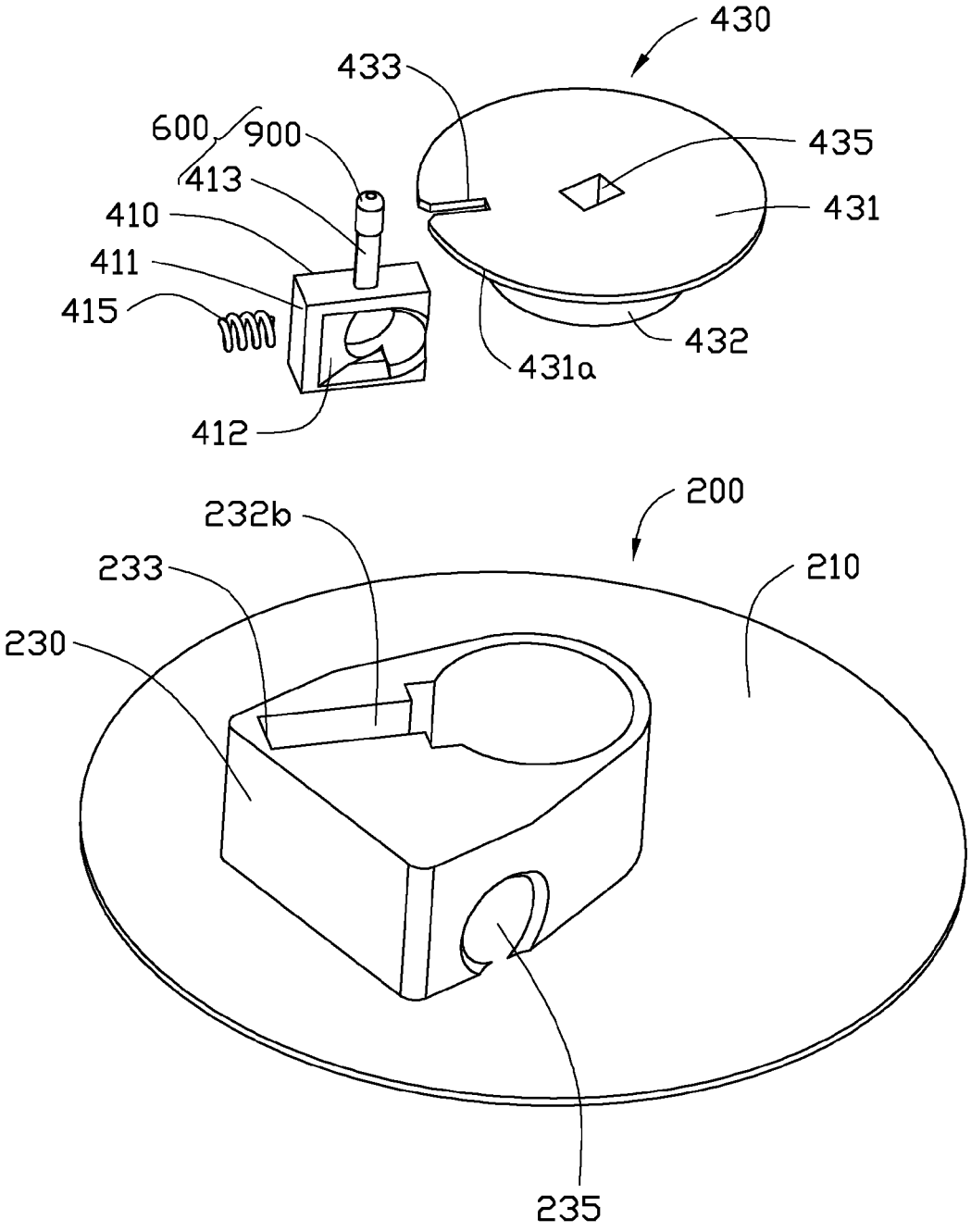
FIG. 4 is an enlarged, perspective view of a part of the wire-winding device of FIG. 2.

Referring also to FIG. 4, a plug inlet channel 235 is defined in a portion of the closed side wall 231 corresponding to the moving cavity 232*b*. The plug inlet channel 235 runs from one side face of the closed side wall 231, through the moving cavity 232*b*, to an opposite side face of the closed side wall 231. The plug inlet channel 235 is provided for receiving a plug 90 (see FIG. 5) of the earphone set, whereby the plug 90 passes through the moving cavity 232*b*. In the embodiment, the plug inlet channel 235 is slanted relative to a lengthwise axis of the moving cavity 232*b*.

A spring lid 430 is provided to cover a top of the accommodating cavity 232*a* and a part of the moving cavity 232*b* of the indentation 232. The spring lid 430 includes a base cover 431, and a protrusion block 432 extending down from a center portion of the base cover 431. The base cover 431 is arranged to correspond to the through hole 530 of the top cover 50, and is coplanar with the top cover 50. The protrusion block 432 is nested in the accommodating cavity 232*a*, and abuts an inner surface of the closed side wall 231 defining the accommodation cavity 232*a*. A bottom end of the protrusion block 432 is spaced from the torsion spring 300. A securing hole 435 is defined through the base cover 431 and the protrusion block 432. The securing shaft 114 is engagingly received in the securing hole 435, and the spring lid 430 is thereby fixed relative to the housing 10. Accordingly, when the rotation body 200 rotates, the spring lid 430 is prevented from rotating with the rotation body 200. A locking slot 433 is defined in a circumference 431*a* of the base cover 431, and extends in a radial direction of the base cover 431. In the embodiment, a diameter of the base cover 431 is a little less than a diameter of the through hole 530, so that an annular gap between the base cover 431 and the top cover 50 defines an annular guideway 700 (see FIG. 1).

The wire-winding device 1 further includes a locking unit 40, which is configured to lock the rotary wire-winding unit 30 in a desired position and prevent rotary movement of the rotary wire-winding unit 30 when the rotary wire-winding unit 30 is in the locked state. The locking unit 40 can also be driven to release its locking of the rotary wire-winding unit 30, by inserting the plug 90 into the plug inlet channel 235. When the plug 90 is inserted in the plug inlet channel 235 and no pulling force is applied on the wire 80 of the earphone set by a user (operator), the locking unit 40 allows free rotation of the rotary wire-winding unit 30 so as to make the rotary wire-winding unit 30 rotate in a first direction and rewind and gather the wire 80 automatically. On the other hand, when the wire 80 has been rewound and the plug 90 is in place in the plug inlet channel 235, and a pulling force is applied by the user to unwind the wire 80 so as to extend the wire 80, the rotary wire-winding unit 30 rotates in a second direction opposite to the first direction, and the wire 80 can be pulled out until the plug 90 is ready to be drawn out of the plug inlet channel 235. In the embodiment, the first direction is clockwise, and the second direction is counterclockwise.

The locking unit 40 includes a moving member 410 slidably accommodated in the moving cavity 232*b*, a locking member 413 upwardly extending from the moving member 410, and a spring 415 such as a coil spring.

A length of the moving cavity 232*b* determines the extent to which the moving member 410 can slide along the moving cavity 232*b*. The spring 415 is arranged along the lengthwise axis of the moving cavity 232*b*, and is sandwiched between the moving member 410 and the abutting wall 233. In the embodiment, one end of the spring 415 abuts against the abutting wall 233, and the other end of the spring 415 rests against a side surface 411 of the moving member 410 facing towards the abutting wall 233. The locking member 413 is configured to be slidably engaged in the locking slot 433. In an alternative embodiment, the locking member 413 extends downwardly from the spring lid 430, and accordingly, the locking slot 433 is defined in the moving member 410.

The moving member 410 receives a thrust force from a free end of the plug 90, when the plug 90 is pushed into the plug inlet channel 235 by the user and reaches the moving cavity 232*b*. Thereby, the moving member 410 slides outwardly along the lengthwise axis of the moving cavity 232*b* so as to make the locking member 413 disengage from the locking slot 433. The moving member 410 includes a contact surface 412 configured for receiving the thrust force. The contact surface 412 is an oblique surface facing towards an inner opening of the plug inlet channel 235 at the moving cavity 232*b*. When the plug 90 is inserted into the plug inlet channel 235, the free end of the plug 90 abuts against the contact surface 412 so as to generate the thrust force applied to the contact surface 412. Thus the whole moving member 410 is moved along the moving cavity 232*b* by the thrust force, compressing the spring 415, and making the locking member 413 disengaged from the locking slot 433.

In the embodiment, a cap 900 is sleeved on and fixed to a free end of the locking member 413. The cap 900 cooperates with the locking member 413 to function as an operation handle 600 to receive the user's thumb press. When the locking member 413 is disengaged from the locking slot 433, the user can push the operation handle 600 and thereby drive the locking member 413 to move along the guideway 700 so that the rotary wire-winding unit 30 rotates. Alternatively, another kind of handle can be fixed to the locking member 413, as a substitute for the above-mentioned operation handle 600. The other handle can be operated by the user to drive the locking member 413 to move along the guideway 700 so that the rotary wire-winding unit 30 rotates.

In assembly of the wire-winding device 1, the rotation body 200 is inserted into the housing 10, with the securing shaft 114 passing through the shaft hole 212, entering the accommodation cavity 232*a* and protruding beyond a top of the accommodation cavity 232*a*. Thereby, the supporting plate 210 of the rotation body 200 is sleeved around the pivot 112 of the housing 10. One end 310 of the torsion spring 300 is placed around the securing shaft 114, and the other end 310 of the torsion spring 300 is hooked onto the latching member 237. Thereby, the torsion spring 300 is fixed into the rotation body 200. At this time, the torsion spring 300 is in an elastically deformed state, storing a certain amount of elastic potential energy. Then the spring 415 together with the moving member 410 are accommodated in the moving cavity 232*b*. The moving member 410 and the spring 415 sit in a straight line along the lengthwise axis of the moving cavity 232*b*, with the spring 415 sandwiched between the moving member 410 and the abutting wall 233. The spring lid 430 covers the indentation 232, and the securing shaft 114 is engaged in the securing hole 435. The protrusion block 432 of the spring lid 430 is received in the accommodation cavity 232*a*; and the location of the locking slot 433 of the base cover 431 is arranged to correspond with the moving cavity 232*b*, so that the locking member 413 engages in the locking slot 433. In this position, the top cover 50 conceals the top circumferential edge of the housing 10, and the end of the locking member 413 with the cap 900 protrudes up higher than the guideway 700, so that the rotary wire-winding unit 30 can freely rotate when the locking member 413 is located in the guideway 700.

In the embodiment, after finishing the assembly of the wire-winding device 1, the torsion spring 300 is in the elastically deformed state, and the locking member 413 is received in the locking slot 433.

Figure 5:
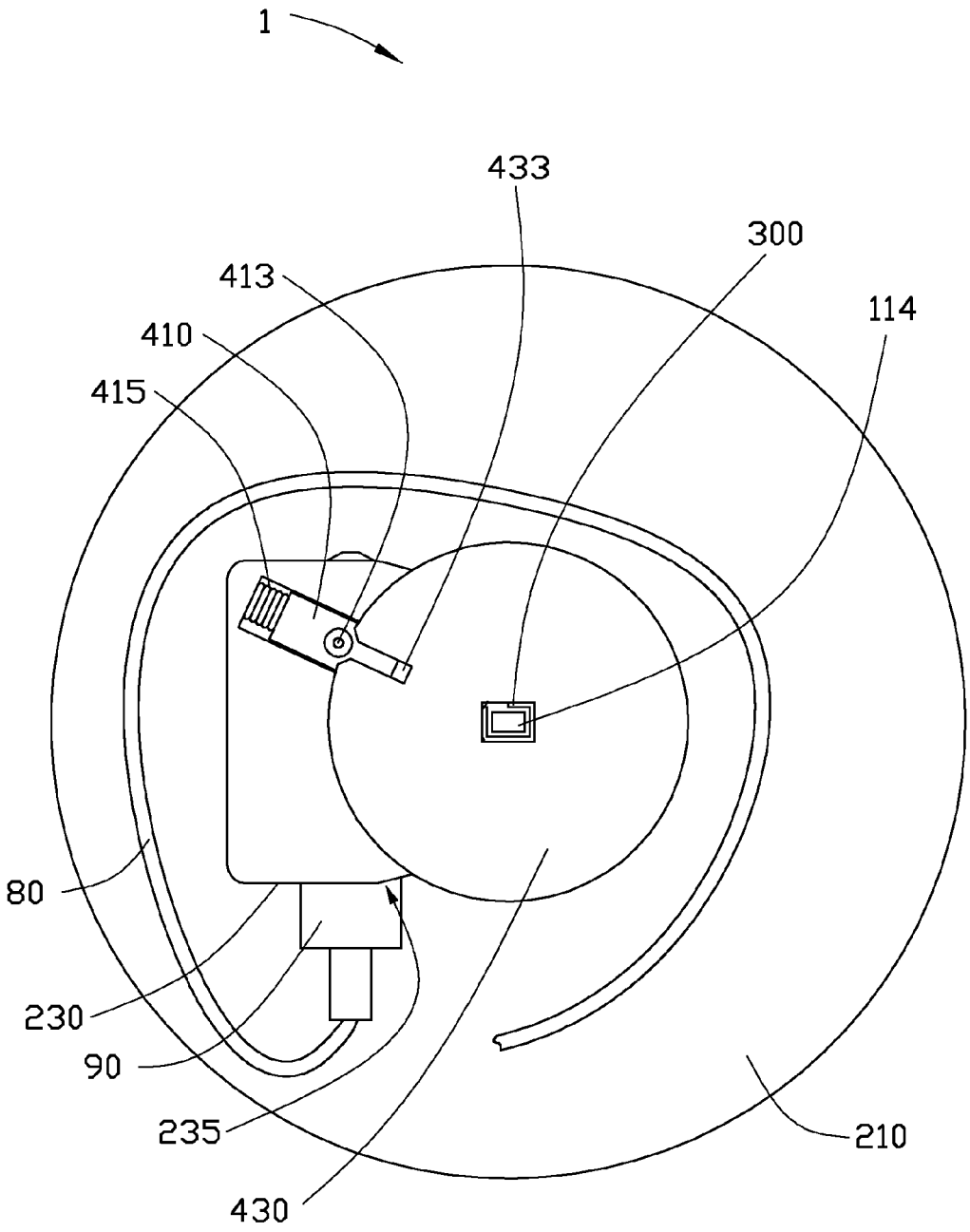
FIG. 5 is a top plan view of the wire-winding device of FIG. 1, but omitting a top cover thereof, and showing a plug of a wire inserted in the wire-winding device.

The operation principles of the wire-winding device 1 are briefly described below:

Referring to FIG. 5, when the plug 90 is inserted through the entrance 122 into the plug inlet channel 235 of the rotation body 200, the free end of the plug 90 pushes the contact surface 412 of the moving member 410, applying a thrust force against the moving member 410. The moving member 410 is driven towards the abutting wall 233, compressing the spring 415, so as to make the locking member 413 disengage from the locking slot 433 and enter the guideway 700. Thus, the locking unit 40 is unlocked. The torsion spring 300 releases its elastic potential energy to drive the rotary wire-winding unit 30 to rotate in the first direction. Simultaneously, the locking member 413 together with the cap 900 rotates, with the locking member 413 traveling in the guideway 700 along the first direction. Therefore, the wire 80 of the earphone set is automatically rewound onto and around the wire-collecting surface 239 by the rotation of the rotary wire-winding unit 30.

Then when an end portion of the wire 80 at the earpieces of the earphone set is pulled out from the wire-winding device 1 by the user, because the plug 90 is still inserted in the plug inlet channel 235, the locking unit 40 is still in an unlocked status, and the rotary wire-winding unit 30 is rotated in the second direction by the pulling force. That is, the wire 80 can be pulled out until the plug 90 is able to be drawn out of the plug inlet channel 235. During the pulling action on the wire 80, the deformation of the torsion spring 300 is cumulatively increased, due to the reversed rotation of the rotation body 200.

Figure 6:
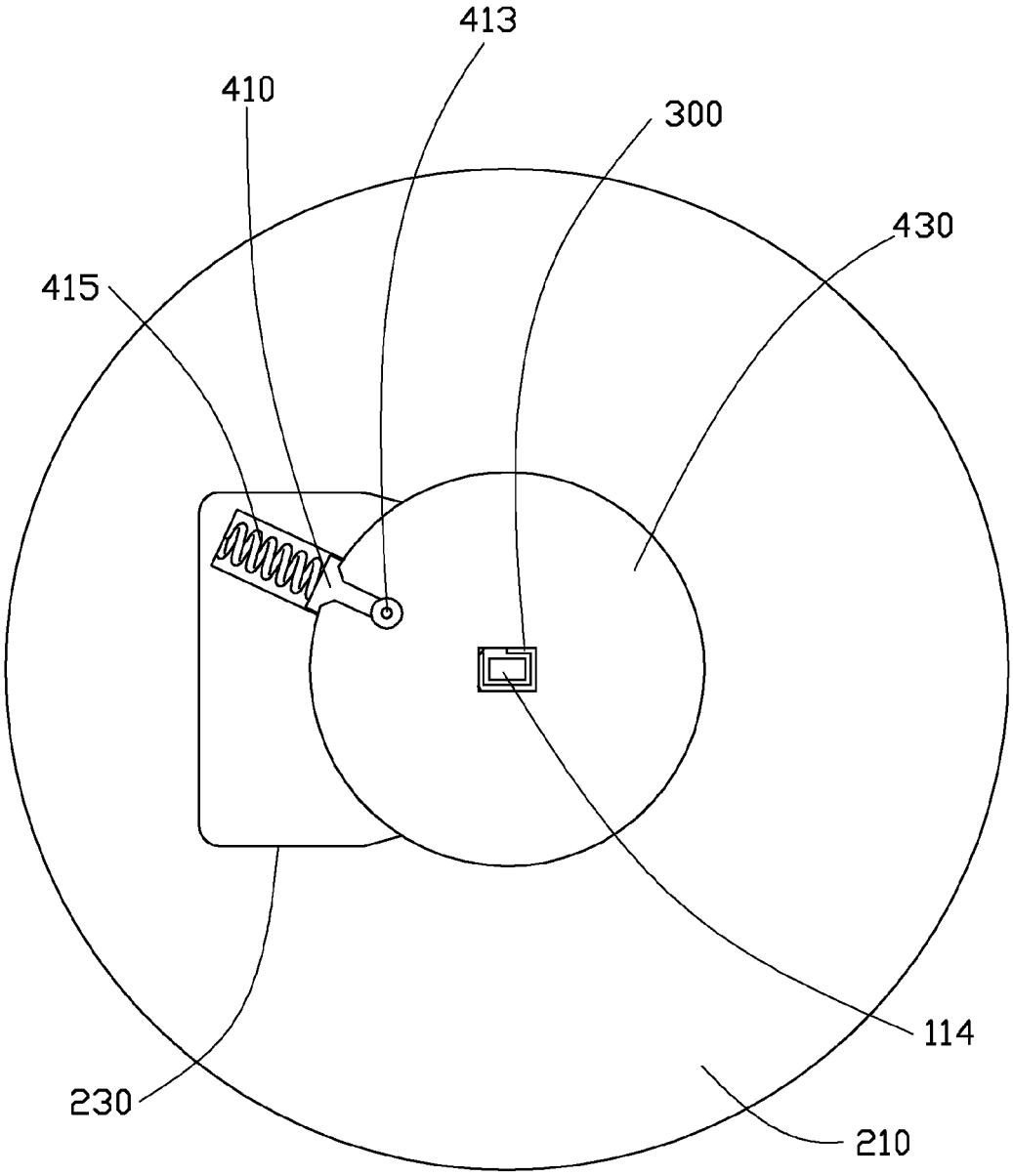
FIG. 6 is similar to FIG. 5, but showing the wire-winding device without the plug and wire.

Referring to FIG. 6, when the plug 90 is drawn out of the plug inlet channel 235, the force applied on the moving member 410 is eliminated. Therefore, the moving member 410 is pushed back radially inwardly by the spring 415, so that the locking member 413 is engaged in the locking slot 433. In such case, re-rotation of the rotary wire-winding unit 30 is prevented by the locking unit 40, and the wire 80 of the earphone set can remain completely drawn out of the wire-winding device 1.

In the embodiment, the rotary wire-winding unit 30 can for example be pushed to move along the guideway 700 by operation of the operation handle 600, when the plug 90 is inserted into the plug inlet channel 235. Therefore even if the torsion spring 300 does not have sufficient elastic potential energy to fully wind up the wire 80 of the earphone set, the user can still operate the operation handle 600 and thereby push the locking member 413 to move along the guideway 700 so that the rotary wire-winding unit 30 rotates and fully winds up the wire 80.

According to the above, the wire 80 of the earphone set can be automatically wound up on the rotary wire-winding unit 30 by the thrust force applied by the free end of the plug 90 when the plug 90 is inserted into the plug inlet channel 235. This helps avoid wire tangles. Moreover, the wire 80 can be completely pulled out from the wire-winding device 1 and freed from the wire-winding device 1 by the user. Therefore, the earpieces and wire 80 of the earphone set can be completely detached from the wire-winding device 1 according to user requirements. For example, after such detachment, the user may employ a different earphone set with the wire-winding device 1, by inserting a plug of the other earphone set into the plug inlet channel 235. Thus the wire-winding device 1 is even more convenient for everyday portable use.

Although numerous characteristics and advantages of the present embodiments have been set out in the foregoing description, together with details of the structures and functions of the embodiments, the disclosure is illustrative only; and changes may be made in detail, especially in the matters of shape, size and arrangement of parts within the principles of the disclosure to the full extent indicated by the broad general meaning of the terms in which the appended claims are expressed.

What is claimed is:

1. A wire-winding device, comprising:

a rotary wire-winding unit configured for automatically winding a wire therearound, the rotary wire-winding unit comprising:

a moving cavity; and a plug inlet channel in communication with the moving cavity, and configured for receiving a plug attached to an end of the wire; and a locking unit configured for locking the rotary wire-winding unit to prevent rotation of the rotary wire-winding unit and for releasing the locking of the rotary wire-winding unit depending on whether a thrust force is applied on the locking unit; the locking unit comprising a moving member accommodated in the moving cavity, the moving member configured to receive the thrust force and move in the moving cavity under the thrust force;

wherein when the plug is received in the plug inlet channel, the plug applies the thrust force on the moving member, the moving member moves in the moving cavity, and the locking unit releases the locking of the rotary wire-winding unit to allow the rotary wire-winding unit to rotate and automatically wind the wire.

2. The wire-winding device of claim 1, wherein the moving member comprises a contact surface configured to receive the thrust force applied on the moving member, and the contact surface is an oblique surface arranged facing towards an inner opening of the plug inlet channel at the moving cavity.

3. The wire-winding device of claim 1, wherein when the plug is inserted into the plug inlet channel, the locking unit releases the locking of the rotary wire-winding unit and allows free rotation of the rotary wire-winding unit such that the rotary wire-winding unit rotates in a first direction and winds and gathers the wire automatically.

4. The wire-winding device of claim 3, wherein when the wire is in a position wound around the rotary wire-winding unit and the plug is in place in the plug inlet channel, and an external pulling force is applied to an end portion of the wire by a user, the rotary wire-winding unit rotates in a second direction opposite to the first direction.

5. The wire-winding device of claim 4, wherein the locking unit further comprises a locking slot and a locking member configured to be removably engaged in the locking slot; when the moving member does not receive the thrust force, the locking member is engaged in the locking slot and the rotary wire-winding unit is locked; and when the moving member receives the thrust force and moves in the moving cavity, the locking member is disengaged from the locking slot.

6. The wire-winding device of claim 5, further comprising a spring lid partly received in the rotary wire-winding unit so as to cover a part of the moving cavity, wherein the spring lid remains stationary when the rotary wire-winding unit rotates.

7. The wire-winding device of claim 6, wherein one of the locking member and the locking slot is located at the spring lid, and the other one of the locking member and the locking slot is located at the moving member.

8. The wire-winding device of claim 6, wherein the locking member upwardly extends from the moving member towards the spring lid, and the locking slot is defined in the spring lid.

9. The wire-winding device of claim 6, further comprising a housing configured for accommodating the rotary wire-winding unit, wherein a pivot with a securing shaft is provided on a bottom plate of the housing, the securing shaft extends coaxially from an end of the pivot that is away from the bottom plate, the pivot extends through a hole of the rotary wire-winding unit such that the rotary wire-winding unit is rotatable around the pivot, and the securing shaft is fixed in a securing hole of the spring lid.

10. The wire-winding device of claim 9, further comprising a top cover covering a top peripheral edge of the housing, wherein the top cover defines a through hole in the middle thereof.

11. The wire-winding device of claim 10, wherein the spring lid comprises a base cover and a protrusion block extending down from the base cover, the base cover is arranged in the through hole of the top cover, and an annular gap is defined between an outer edge of the base cover and an inner edge of the top cover defining the through hole, the annular gap defining an annular guideway for allowing the locking member to slide therein during the rotation of the rotary wire-winding unit.

12. The wire-winding device of claim 11, wherein an operation handle is fixed to the locking member, and the operation handle is operable by a user to force the locking member to rotate in the guideway and thereby drive the rotary wire-winding device to rotate.

13. The wire-winding device of claim 10, wherein the top cover further defines a pair of accommodation grooves for accommodating a pair of earpieces associated with the wire.

14. The wire-winding device of claim 9, wherein the rotary wire-winding unit further comprises a torsion spring, one end of the torsion spring is fixed to the securing shaft, and the other end of the torsion spring is fixed to rotary wire-winding unit, whereby the torsion spring stores elastic potential energy such that when the locking unit releases the locking of the rotary wire-winding unit, the torsion spring releases the elastic potential energy and drives the rotary wire-winding unit to rotate and automatically wind the wire.

15. The wire-winding device of claim 14, wherein the rotary wire-winding unit further comprises a supporting plate and an accommodation member provided on the supporting plate, and the moving cavity is defined in the accommodation member.

16. The wire-winding device of claim 15, wherein the accommodation member further defines an accommodation cavity, and the torsion spring is accommodated in the accommodation cavity.

17. The wire-winding device of claim 14, wherein the locking unit further comprises a second spring sandwiched between the moving member and an end surface of the moving cavity; when the moving member moves in the moving cavity and the locking member is disengaged from the locking slot, the second spring is compressed; when the rotary wire-winding unit rotates in the second direction, the torsion spring accumulates elastic potential energy; and when the plug is removed from the plug inlet channel after the rotary wire-winding unit rotates in the second direction, the force applied on the locking unit by the plug is eliminated, and the second spring decompresses and drives the locking member to engage in the locking slot such that the rotary wire-winding unit is locked.

18. The wire-winding device of claim 9, wherein the housing has an entrance defined therein, so as to allow the wire to be routed into and out of the rotary wire-winding unit.

19. The wire-winding device of claim 1, wherein the moving cavity is a straight groove with a smooth inner surface.

20. A wire-winding device for an earphone set, the earphone set comprising a wire and a plug attached to an end of the wire, the wire-winding device comprising:

a rotary wire-winding unit configured for automatically winding the wire therearound, the rotary wire-winding unit comprising:

a moving cavity; and a plug inlet channel configured for receiving the plug;

a torsion spring configured to store elastic potential energy used for driving rotation of the rotary wire-winding unit; and a locking unit configured for locking the rotary wire-winding unit to prevent the rotation of the rotary wire-winding device and for releasing the locking of the rotary wire-winding unit depending on whether a thrust force is applied on the locking unit; the locking unit comprising a moving member accommodated in the moving cavity and a second spring sandwiched between the moving member and an end surface of the moving cavity, the moving member configured to receive the thrust force and move in the moving cavity under the thrust force;

wherein when the plug is received in the plug inlet channel, the plug applies the thrust force on the moving member, the moving member moves in the moving cavity to compress the second spring, the locking unit releases the locking of the rotary wire-winding unit, and the torsion spring releases the elastic potential energy to drive the rotary wire-winding unit to rotate and automatically wind the wire.

* * * * *